US009489004B2

(12) United States Patent
Huang et al.

(10) Patent No.: US 9,489,004 B2
(45) Date of Patent: Nov. 8, 2016

(54) BANDGAP REFERENCE VOLTAGE GENERATOR CIRCUITS

(71) Applicant: GLOBALFOUNDRIES Singapore Pte. Ltd., Singapore (SG)

(72) Inventors: Zhiqi Huang, Singapore (SG); Yoke Weng Tam, Singapore (SG); Bai Yen Nguyen, Singapore (SG); Benjamin Shui Chor Lau, Singapore (SG)

(73) Assignee: GLOBALFOUNDRIES SINGAPORE PTE. LTD., Singapore (SG)

( * ) Notice: Subject to any disclaimer, the term of this patent is extended or adjusted under 35 U.S.C. 154(b) by 47 days.

(21) Appl. No.: 14/292,249

(22) Filed: May 30, 2014

(65) Prior Publication Data

US 2015/0346746 A1 Dec. 3, 2015

(51) Int. Cl.

| | |
|---|---|
| ***G05F 1/46*** | (2006.01) |
| ***G05F 3/30*** | (2006.01) |
| ***G05F 1/56*** | (2006.01) |
| ***G05F 1/10*** | (2006.01) |

(52) U.S. Cl.

CPC . *G05F 3/30* (2013.01); *G05F 1/10* (2013.01); *G05F 1/46* (2013.01); *G05F 1/56* (2013.01)

(58) Field of Classification Search

CPC ..... G05F 1/10
USPC ..... 323/313, 314; 327/539
See application file for complete search history.

(56) References Cited

U.S. PATENT DOCUMENTS

| | | | | |
|---|---|---|---|---|
| 6,882,582 | B2 | 4/2005 | Sicard et al. | |
| 7,193,402 | B2 | 3/2007 | Lee et al. | |
| 7,812,663 | B2 | 10/2010 | Lee et al. | |
| 2005/0168270 | A1* | 8/2005 | Bartel | G05F 3/30 327/539 |
| 2007/0109037 | A1* | 5/2007 | Lin | G05F 3/30 327/539 |
| 2007/0146047 | A1* | 6/2007 | Senriuchi | G01D 3/036 327/512 |
| 2008/0157746 | A1 | 7/2008 | Chen | |
| 2009/0051342 | A1* | 2/2009 | Peng | G05F 3/30 323/313 |
| 2013/0106393 | A1* | 5/2013 | Chang | G05F 3/30 323/313 |
| 2013/0265083 | A1* | 10/2013 | Lin | G05F 3/30 327/103 |

* cited by examiner

*Primary Examiner* — Jeffrey Gblende
*Assistant Examiner* — Trinh Dang
(74) *Attorney, Agent, or Firm* — Lorenz & Kopf, LLP

(57) ABSTRACT

Bandgap reference voltage generator circuits are provided that include an operational amplifier, a current mirror configured to be coupled to a supply voltage, a first branch coupled to the current mirror, a second branch coupled to the first branch, a third branch coupled to the second branch and a fourth branch. The operational amplifier includes a first input configured to receive a first voltage and a second input configured to receive a second voltage, and an output that is configured to generate an output voltage. The current mirror is configured to generate a third voltage and a first current. The first branch is configured to receive a second current that is a first portion of the first current, the second branch is configured to receive a third current that is a second portion of the first current, the third branch is configured to receive a fourth current that is a third portion of the first current, and the fourth branch is configured to receive a fifth current generated by the current mirror. The fifth current is used to generate a bandgap reference voltage.

10 Claims, 2 Drawing Sheets

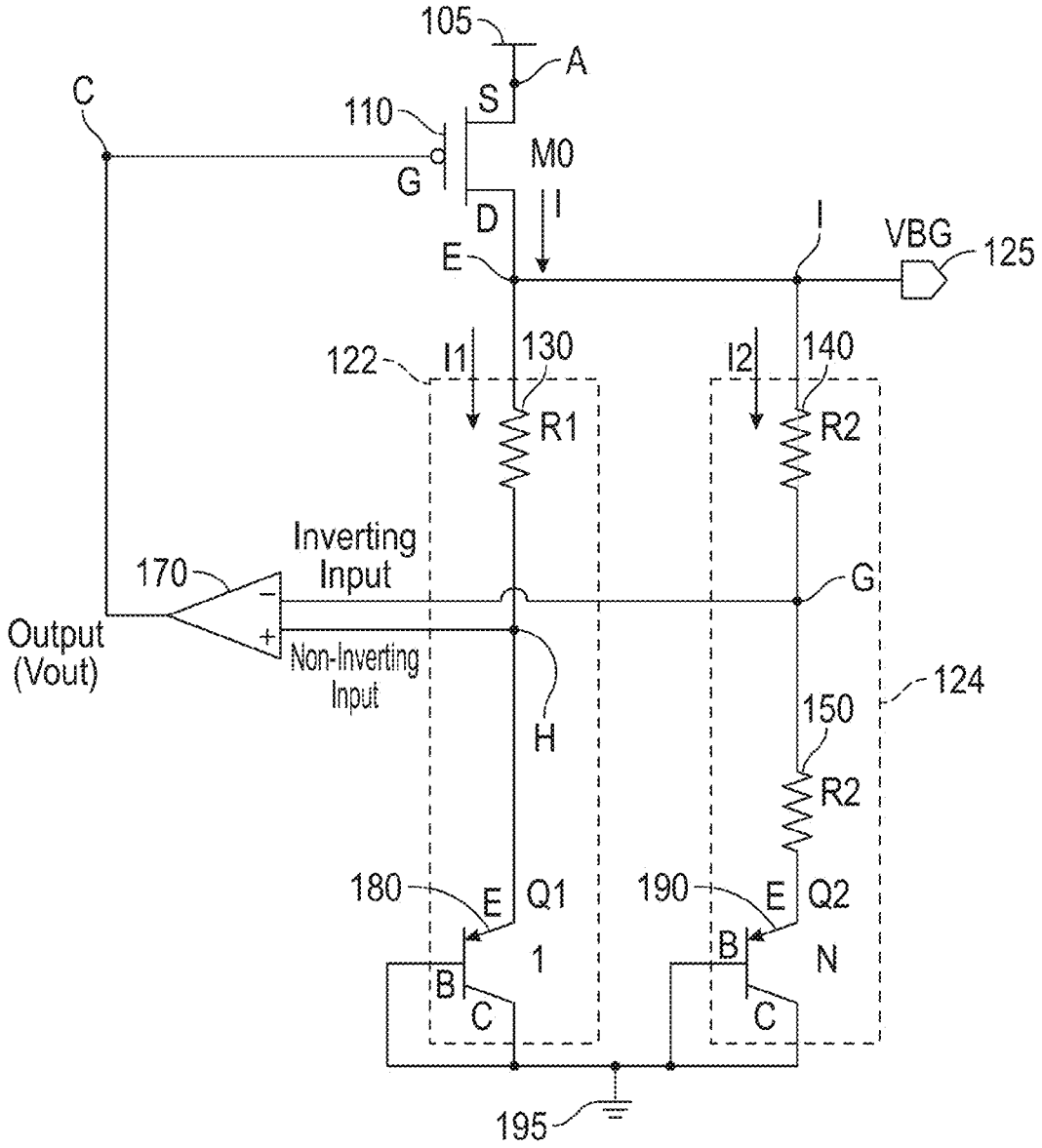
FIG. 1
(Conventional)

BANDGAP REFERENCE VOLTAGE GENERATOR CIRCUITS

TECHNICAL FIELD

Embodiments of the subject matter described herein relate generally to electronic circuits. More particularly, embodiments of the subject matter relate to bandgap reference voltage generator circuits.

BACKGROUND

Many electronic circuits incorporate voltage reference circuits. Bandgap reference generator circuits are widely utilized to generate a bandgap reference voltage that has a negligible temperature coefficient and is independent of temperature (i.e., that should remain constant and stable regardless of changes in temperature). Thus, it's highly desirable that the bandgap reference voltage is substantially independent of temperature variations, or stated differently that a low temperature coefficient (TC).

FIG. 1 is a circuit schematic that shows a conventional bandgap reference generator circuit 100. The bandgap reference generator circuit 100 is connected to a supply voltage (VDD) 105 at node A and generates a bandgap reference voltage (VBG) 125 at node E. The bandgap reference generator circuit 100 includes a P-channel metal oxide semiconductor field effect transistor (MOSFET) 110, a first resistor (R1) 130 having a first resistance value, a second resistor (R2) 140 having a second resistance value, a third resistor (R2) 150 having the second resistance value, an operational amplifier 170, a first bipolar junction transistor 180, and a second bipolar junction transistor 190.

The P-channel MOSFET 110 includes a source terminal coupled to a supply voltage (VDD) 105 at node A, a control terminal or gate coupled to an output of the operational amplifier 170 at node C and a drain terminal coupled to node E.

The operational amplifier 170 includes an inverting input, a non-inverting input, and an output. The operational amplifier 170 receives a voltage generated at node G at its inverting input and another voltage generated at node H at its non-inverting input, and based on these inputs generates an output voltage (Vout) at its output. The output voltage generated by the operational amplifier 170 is applied at the gate terminal of MOSFET 110. When the MOSFET 110 is operating in its saturation region, the MOSFET 110 operates as a current source and generates a current (I) that is output from its drain terminal to node E.

The bandgap reference generator circuit 100 includes a first branch 122 and a second branch 124. The first branch 122 includes the first resistor 130 that is coupled to a first PNP bipolar junction transistor (BJT) 180 at node H. The second branch includes the second resistor 140 that is coupled to the third resistor 150, and the third resistor 150 is coupled to the emitter terminal of a second PNP bipolar junction transistor (BJT) 190. The base and collector terminals of the first and second bipolar junction transistors 180, 190 are coupled to ground 195. The PN junction area (or size) of the first bipolar junction transistor 180 is N times smaller than the PN junction area of the second bipolar junction transistor 190. In one exemplary implementation, the integer N is equal to eight, which means that the bipolar junction transistor 190 is equivalent to eight instances of the first bipolar junction transistor 180. As such, in this example, the ratio of the PN junction area of the second bipolar junction transistor 190 and the PN junction area of the first bipolar junction transistor 180 is 8:1.

The current (I) generated at the drain terminal of MOSFET 110 flows into node E and splits into current (I1) that flows through the first branch 122 and a current (I2) that flows through the second branch 124. The portion (I2) of the current (I) that flows through the second branch 124 generates the bandgap reference voltage 125. The bandgap reference voltage 125 can be approximated as shown in expression (1) as follows:

$$V_{BG} \approx V_{BE} + 17.2 \times V_T \quad (1).$$

Ideally, it is desirable that the temperature coefficient ($TC_{VBG}$) of the bandgap reference voltage 125 is as close to zero as possible. The temperature coefficient ($TC_{VBG}$) of the bandgap reference voltage 125 can be represented in expression (2) as follows:

$$TC_{VBG} = TC_{VBE1} + 17.2 \times TC_{VT} = 0 \quad (2),$$

where the temperature coefficient ($TC_{VBE1}$) of the base-to-emitter voltage ($V_{BE}$) of the first PNP bipolar junction transistor (BJT) 180 is approximately −1.5 mV/° K and where the temperature coefficient ($TC_{VT}$) of the thermal voltage ($V_T$) is approximately 0.087 mV/° K.

The difference between the first base-to-emitter voltage ($V_{BE1}$) and the second base-to-emitter voltage ($V_{BE2}$) can be expressed in expression (3) as follows:

$$\Delta V_{BE} = V_{BE1} - V_{BE2} = VT \times \ln N \quad (3).$$

Further, the current (I2) 214 that flows along branch 124 can be represented in expression (4) as follows:

$$I_2 = \frac{V_{BE1} - V_{BE2}}{R3} = \frac{\Delta V_{BE}}{R3}. \quad (4)$$

In FIG. 1, the bandgap reference voltage ($V_{BG}$) 125 can be approximated via expressions (5) and (6) as follows:

$$V_{BG} \approx V_{BE2} + I_2 \times (R_3 + R_2), \quad (5)$$

$$V_{BG} \approx V_{BE2} + \frac{V_T \times \ln N}{R_3}(R_3 + R_2). \quad (6)$$

The bandgap reference generator circuit 100 works well in many applications, but does not operate as expected in other applications. For the bandgap reference generator circuit 100 to work properly, the MOSFET 110 must operate in its saturation region as a current source. However, when a supply voltage (VDD) 105 is too low, the MOSFET 110 will operate its linear region and the bandgap reference generator circuit 110 will not produce the bandgap reference voltage 125 that is required. For example, when the supply voltage (VDD) 105 that is utilized in the circuit becomes a low value, for example, 1.35 V, the MOSFET 110 operates its linear region and no longer operates the current source. Because the MOSFET 110 cannot operate in its saturation region with this low supply voltage (VDD) 105, the resulting bandgap reference voltage (VBG) 125 is no longer high enough and cannot satisfy the relationship of expression (6) (above).

For instance, in one implementation, where the base to emitter voltage (VBE2) of the second bipolar junction transistor 190 is 0.75 V, the thermal voltage is 0.029 V, N is equal to eight (8), the first resistance value of the first resistor (R1) 130 is 72 kΩ and the second resistance value of the second resistor (R2) 140 and the third resistor (R2) 150 are 10 kΩ, then the bandgap reference voltage (VBG) 125 will only be 1.25 V.

Accordingly, it is desirable to provide improved bandgap reference generator circuits that are capable of working with lower power supply voltages (VDD) (e.g., 1.5 volts or less). It would also be desirable if such a bandgap reference generator circuit is capable of generating a lower bandgap reference voltage (e.g., 0.8 volts or less) having a low temperature coefficient (e.g., near zero, for example, 12 parts per million or less). It would also be desirable if such a bandgap reference generator circuit can be implemented using MOSFET technology that consumes less current. Furthermore, other desirable features and characteristics of the present invention will become apparent from the subsequent detailed description of the invention and the appended claims, taken in conjunction with the accompanying drawings and this background of the invention The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

BRIEF SUMMARY OF EMBODIMENTS

In accordance with some of the disclosed embodiments, a bandgap reference voltage generator circuit is provided that includes an operational amplifier, a current mirror configured to be coupled to a supply voltage, a first branch coupled to the current mirror, a second branch coupled to the first branch, a third branch coupled to the second branch and a fourth branch. The operational amplifier includes a first input configured to receive a first voltage and a second input configured to receive a second voltage, and an output that is configured to generate an output voltage. The current mirror is configured to generate a third voltage and a first current. The first branch is configured to receive a second current that is a first portion of the first current, the second branch is configured to receive a third current that is a second portion of the first current, the third branch is configured to receive a fourth current that is a third portion of the first current, and the fourth branch is configured to receive a fifth current, generated by the current mirror, that is used to generate a bandgap reference voltage.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

FIG. 1 is a circuit schematic that shows a conventional bandgap reference generator circuit.

DETAILED DESCRIPTION

Figure 2:
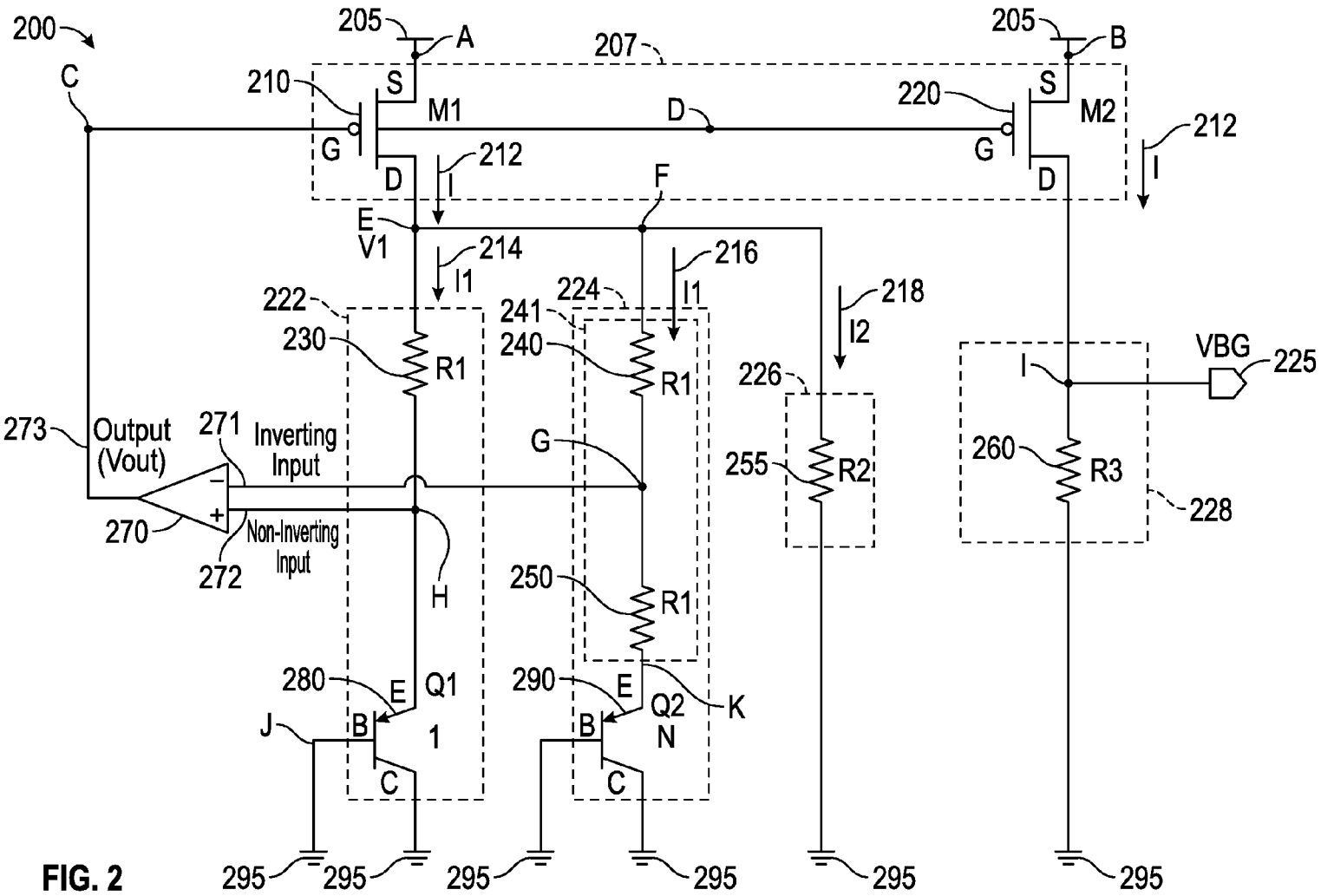
FIG. 2 is a circuit schematic that shows a bandgap reference generator circuit in accordance with the disclosed embodiments.

The following detailed description is merely illustrative in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over other implementations. Furthermore, there is no intention to be bound by any expressed or implied theory presented in the preceding technical field, background, brief summary or the following detailed description.

The connecting lines shown in the various figures contained herein are intended to represent example functional relationships and/or physical couplings between the various elements. It should be noted that many alternative or additional functional relationships or physical connections may be present in an embodiment. As used herein, a "node" means any internal or external reference point, connection point, junction, signal line, conductive element, or the like, at which a given signal, logic level, voltage, data pattern, current, or quantity is present. Furthermore, two or more nodes may be realized by one physical element (and two or more signals can be multiplexed, modulated, or otherwise distinguished even though received or output at a common node).

The following description refers to elements or nodes or features being "connected" or "coupled" together. As used herein, unless expressly stated otherwise, "coupled" means that one element/node/feature is directly or indirectly joined to (or directly or indirectly communicates with) another element/node/feature, and not necessarily mechanically. Likewise, unless expressly stated otherwise, "connected" means that one element/node/feature is directly joined to (or directly communicates with) another element/node/feature, and not necessarily mechanically. In addition, certain terminology may also be used in the following description for the purpose of reference only, and thus are not intended to be limiting. For example, terms such as "first," "second," and other such numerical terms referring to elements or features do not imply a sequence or order unless clearly indicated by the context.

FIG. 2 is a circuit schematic that shows a bandgap reference generator circuit 200 in accordance with the disclosed embodiments. Nodes A through K are labeled on FIG. 2 for reference purposes. The bandgap reference generator circuit 200 can be coupled to a supply voltage ($V_{DD}$) 205 at nodes A and B and can generate a bandgap reference voltage ($V_{BG}$) 225 at node I.

The bandgap reference generator circuit 200 includes a current mirror 207, an operational amplifier 270, a first branch (or current path) 222, a second branch 224, a third branch 226 and a fourth branch 228.

The current mirror 207 includes a first P-channel MOSFET (M1) 210 and a second P-channel MOSFET (M2) 220.

The first P-channel MOSFET 210 includes a source terminal configured to be coupled to a supply voltage ($V_{DD}$) 205 at node A, a control terminal or gate coupled to an output of the operational amplifier 270 at node C and a drain terminal coupled to node E. When the first P-channel MOSFET (M1) 210 is operating in its saturation region, the MOSFET 210 operates as a current source and generates a current (I) 212 that is output from its drain terminal to node E and generates a voltage ($V_1$) at node E.

The second P-channel MOSFET 220 includes a source terminal configured to be coupled to a supply voltage ($V_{DD}$)

205 at node B, a control terminal or gate coupled to the gate terminal of the first P-channel MOSFET (M1) 210 at node D, and a drain terminal coupled to node I. The second P-channel MOSFET (M2) 220 that is substantially identical to the first P-channel MOSFET (M1) 210 meaning that the devices have substantially identical device characteristics. For example, in one embodiment, the first P-channel MOSFET 210 includes a first gate having a width-to-length value, and the second P-channel MOSFET 220 includes a second gate also having a width-to-length value that is substantially identical to that of the first P-channel MOSFET 210. When the second P-channel MOSFET (M2) 220 is operating in its saturation region, the MOSFET 220 operates as a current source and generates a current (I) 212 that is output from its drain terminal to node I and generates a bandgap reference voltage ($V_{BG}$) at node I.

The operational amplifier 270 includes an inverting input 271, a non-inverting input 272, and an output 273. The operational amplifier 270 receives a voltage generated at node G at its inverting input 271 and another voltage generated at node H at its non-inverting input 272, and based on these inputs generates an output voltage ($V_{out}$) at its output 273. The output voltage generated by the operational amplifier 270 is applied at the gate terminal of first P-channel MOSFET (M1) 210 at node C and at the gate terminal of the second P-channel MOSFET (M2) 220 at node D to adjust the first current (I) 212 output by the first P-channel MOSFET 210 and the second P-channel MOSFET 220. Because the first P-channel MOSFET (M1) 210 and the second P-channel MOSFET (M2) 220 are identical (e.g., have the same characteristics) and coupled together at their respective gate terminals at node D, the current (I) 212 that is generated by the first P-channel MOSFET (M1) 210 and the current (I) 212 that is generated by the second P-channel MOSFET (M2) 220 will be identical or "mirrored."

The drain terminal of the first P-channel MOSFET 210 outputs the current (I) 212 splits into a first current (I1) 214 that flows along the first branch 222, a second current (I2) 216 that flows along the second branch 224, and a third current (I2) 218 that flows along the third branch 226. Currents (I1) 214, 216 are identical and current (I2) 218 is substantially less than currents (I1) 214, 216. The currents into and out of node E can be represented in expression (7) as follows:

$$I=2I_1+I_2 \quad (7).$$

The first branch 222 includes the first resistor (R1) 230 that is coupled to an emitter (E) terminal of a first p-type or "PNP" bipolar junction transistor (BJT) (Q1) 280 at node H. The base (B) and collector (C) terminals of the first PNP BJT (Q1) 280 are coupled to ground 295. The first PNP BJT (Q1) 280 has a first base-to-emitter voltage ($V_{BE1}$). The second branch includes a second resistor (R1) 240 that is coupled to a third resistor (R1) 250 at node G, and a second PNP bipolar junction transistor (BJT) (Q2) 290 that is coupled to ground 295. The resistance values of resistors 230, 240, 250 are substantially identical, and in some embodiments are between 40 kΩs and 60 kΩs. An emitter (E) terminal of the second PNP BJT (Q2) 290 is coupled to the third resistor (R1) 250 at node G, and the base (B) and collector (C) terminals of the second PNP BJT (Q2) 290 are coupled to ground 295. The PN junction area of the first PNP BJT (Q1) 280 is N times smaller than the PN junction area of the second PNP BJT (Q2) 290. In one exemplary implementation, the integer N is equal to eight, which means that the second PNP BJT (Q2) 290 is equivalent to eight instances of the first PNP BJT (Q1) 280 coupled to each other in parallel. Here, the term size refers to the PN junction area of the bipolar junction transistor. As such, in this example, the ratio of the PN junction area of the second PNP BJT (Q2) 290 to the PN junction area of the first PNP BJT (Q1) 280 is 8:1, which means that the PN junction area of the second PNP BJT (Q2) 290 is 8× larger than the PN junction area of the first PNP BJT (Q1) 280. As a result, the second base-to-emitter voltage ($V_{BE2}$) of the second PNP BJT (Q2) 290 is less than the first base-to-emitter voltage ($V_{BE1}$) of the 280. The difference between the second base-to-emitter voltage ($V_{BE2}$) and the first base-to-emitter voltage ($V_{BE1}$) can be expressed in expression (8) as follows:

$$\Delta V_{BE}=V_{BE1}-V_{BE2} \quad (8).$$

Further, the first current (I1) 214 that flows along the first branch 222 can be represented in expression (9) as follows:

$$I_1=\frac{V_{BE1}-V_{BE2}}{R1}=\frac{\Delta V_{BE}}{R1}=f(\Delta V_{BE}). \quad (9)$$

The second current (I2) 216 that flows the second branch 224 can be represented in expression (10) as follows:

$$I_2=\frac{I_1\cdot R1+V_{BE1}}{R2}=\frac{\Delta V_{BE}}{R_2}+\frac{V_{BE1}}{R_2}=f(\alpha\cdot\Delta V_{BE}+\beta\cdot V_{BE1}). \quad (10)$$

In accordance with the disclosed embodiments, the third branch 226 includes the fourth resistor (R2) 255 coupled to ground 295. The current (I2) 218 flows through the fourth resistor (R2) 255 of the third branch 226 to generate a voltage (VF) that lowers the voltage ($V_1$) at node E so that the voltage ($V_1$) is low enough to cause the first P-channel MOSFET 210 operate in saturation mode when the supply voltage ($V_{DD}$) 205 is low (e.g., 1.35 volts or less). To explain further, the difference between the supply voltage ($V_{DD}$) 205 and the voltage ($V_1$) at node E will be greater than the difference between the gate-to-source voltage ($V_{GSM1}$) of the first P-channel MOSFET 210 and the threshold voltage (Vth) of the first P-channel MOSFET 210, which causes the first P-channel MOSFET 210 to operate in saturation mode.

The stability of the bandgap voltage reference ($V_{BG}$) 225 should not be influenced when temperature changes. Even though adding the third branch 226 can lower the voltage ($V_1$), the temperature coefficient (TC) of the bandgap voltage reference ($V_{BG}$) 225 would not be low enough (i.e., near zero or negligible) without taking additional measures. To help achieve this, the fourth branch 228 is provided to ensure that the temperature coefficient ($TC_{VBG}$) of the bandgap voltage reference ($V_{BG}$) 225 is low enough (i.e., near zero or negligible). In accordance with the disclosed embodiments, the fourth branch 228 is coupled to the second P-channel MOSFET (M2) 220 of the current mirror 207 and includes the fifth resistor (R3) 260 having one terminal that is coupled to node I, and another terminal that is coupled to ground 295. The current (I) 212 generated at the drain terminal of MOSFET (M2) 220 flows into node I and generates the bandgap reference voltage ($V_{BG}$) 225 at node I.

The bandgap reference voltage ($V_{BG}$) 225 can be represented in expression (11) as follows:

$$V_{BG}=I\cdot R_3=(2I_1+I_2)\cdot R_3=2\cdot R3\cdot I_1+R3\cdot I_2 \quad (11).$$

When the expression (9) for $I_1$ and the expression (10) for $I_2$ are substituted into expression (11), the bandgap reference voltage ($V_{BG}$) 225 can be represented in expression (12) as follows:

$$V_{BG} = 2 \cdot R3 \cdot \frac{\Delta V_{BE}}{R1} + R3 \cdot \frac{V_{BE1} + I_1 \cdot R1}{R2}. \quad (12)$$

The expression (12) for the bandgap reference voltage 225 can be expressed as shown in expressions (13) through (16) as follows:

$$V_{BG} = 2 \cdot R_3 \cdot \frac{\Delta V_{BE}}{R_1} + R_3 \cdot \left(\frac{\Delta V_{BE}}{R_2} + \frac{V_{BE1}}{R_2}\right), \quad (13)$$

$$V_{BG} = \frac{R_3}{R_2} \cdot V_{BE1} + \left(2 \cdot \frac{R_3}{R_1} + \frac{R_3}{R_2}\right) \cdot \Delta V_{BE}, \quad (14)$$

$$V_{BG} = \frac{R_3}{R_2} \cdot V_{BE1} + \left(2 \cdot \frac{R_3}{R_1} + \frac{R_3}{R_2}\right) \cdot V_T \cdot \ln N, \quad (15)$$

$$V_{BG} = \alpha \cdot V_{BE1} + \beta \cdot V_T, \quad (16)$$

where $$\propto = \frac{R_3}{R_2}, \alpha > 1 \text{ and}$$

$$\beta = \left(\frac{2R_3}{R_1} + \frac{R_3}{R_2}\right) \ln N.$$

Expression (15) can be re-written by substituting the temperature coefficient ($TC_{VBG}$) of the bandgap voltage reference ($V_{BG}$) 225, the temperature coefficient ($TC_{VBE1}$) of the base-to-emitter voltage ($V_{BE1}$) of the base-to-emitter voltage ($V_{BE}$) of the first PNP bipolar junction transistor (BJT) 180, and the temperature coefficient ($TC_{VT}$) of the thermal voltage ($V_T$) to provide an expression (17) as follows:

$$TC_{VBG} = \frac{R_3}{R_2} \cdot TC_{VBE1} + \left(2 \cdot \frac{R_3}{R_1} + \frac{R_3}{R_2}\right) \cdot \ln N \cdot TC_{VT}, \quad (17)$$

where the temperature coefficient ($TC_{VBE1}$) of the base-to-emitter voltage ($V_{BE}$) of the first PNP bipolar junction transistor (BJT) 180 is approximately −1.5 mV/° K and where the temperature coefficient ($TC_{VT}$) of the thermal voltage ($V_T$) is approximately 0.087 mV/° K.

Therefore, by adding the third branch 226 and the fourth branch 228 and selecting the appropriate resistance values for the resistors (R1) 230, 240 250 and the fifth resistor (R3) 260, it is possible to make the temperature coefficient ($TC_{VBG}$) of the bandgap voltage reference ($V_{BG}$) 225 equal to zero.

In accordance with the disclosed embodiments, the resistance value of the fifth resistor (R3) is set to a value less than the resistance value of the fourth resistor (R2) 255 so that the contribution of the first base-to-emitter voltage ($V_{BE1}$) of the first PNP BJT (Q1) 280 to the bandgap reference voltage ($V_{BG}$) 225 is reduced and the resulting bandgap reference voltage ($V_{BG}$) 225 has a lower value. In essence, the contribution of the first base-to-emitter voltage ($V_{BE1}$) (of the first PNP BJT (Q1) 280) to the bandgap reference voltage ($V_{BG}$) 225 can be reduced to allow the first P-channel MOSFET (M1) 210 and the second P-channel MOSFET (M2) 220 to operate in their saturation regions when a lower supply voltage ($V_{DD}$) 205 (e.g., 1.35 volts) is employed.

Thus, by adding two additional branches the bandgap reference generator circuit 200 will still operate properly even though the supply voltage ($V_{DD}$) 205 and the bandgap reference voltage 225 have relatively low values in comparison the supply voltage ($V_{DD}$) 105 and the bandgap reference voltage 125 of the bandgap reference generator circuit 100 of FIG. 1.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. A bandgap reference voltage generator circuit, comprising:

an operational amplifier comprising: a first inverting input coupled to a first node and being configured to receive a first voltage generated at the first node and a second non-inverting input coupled to a second node and being configured to receive a second voltage generated at the second node, and an output that is configured to generate an output voltage;

a current mirror configured to be coupled to a supply voltage less than or equal to 1.35 volts, wherein the current mirror comprises: a first P-channel MOSFET configured to generate a third voltage and a first current;

a first branch coupled to the current mirror and configured to receive a second current that is a first portion of the first current, wherein the first branch comprises: a first PNP bipolar junction transistor; and a first resistor coupled to the first PNP bipolar junction transistor at the second node that is coupled to the second non-inverting input, wherein the first resistor has a first resistance value;

a second branch coupled to the first branch and configured to receive a third current that is a second portion of the first current, wherein the second branch comprises: a voltage divider comprising: a second resistor coupled to a third resistor and being configured to divide the third voltage to generate the first voltage at the first node that is coupled to the first inverting input, wherein a second resistance value of the second resistor is the same as a third resistance value of the third resistor and the same as the first resistance value of the first resistor;

a third branch coupled between the second branch and ground, wherein the third branch comprises: a fourth resistor having a fourth resistance value and being configured to receive a fourth current that is a third portion of the first current, wherein the fourth current flows through the fourth resistor to generate a fifth voltage that lowers the third voltage low enough to cause the first P-channel MOSFET to operate in saturation mode when the supply voltage is less than or equal to 1.35 volts, wherein a first difference between the supply voltage and the third voltage is greater than a second difference between a gate-to-source voltage of the first P-channel MOSFET and a threshold voltage of the first P-channel MOSFET, which causes the first P-channel MOSFET to operate in saturation mode; and a fourth branch comprising: a fifth resistor coupled to ground and the current mirror, wherein the fifth resistor has a fifth resistance value that is less than the fourth resistance value, wherein the fifth resistor is configured to receive a fifth current from the current mirror that is used to generate a bandgap reference voltage that is less than or equal to 0.8 volts, wherein the fifth resistance value is selected to cause a temperature coefficient of the bandgap reference voltage to be approximately equal to zero.

2. The bandgap reference voltage generator circuit according to claim 1, wherein the current mirror further comprises:

a second P-channel MOSFET configured to generate the fifth current that is identical to the first current generated by the first P-channel MOSFET.

3. The bandgap reference voltage generator circuit according to claim 1, wherein second current is substantially equal to the third current.

4. The bandgap reference voltage generator circuit according to claim 1, wherein the second branch further comprises:

a second PNP bipolar junction transistor coupled between the voltage divider and ground, wherein the first voltage that is less than the third voltage.

5. The bandgap reference voltage generator circuit according to claim 1, wherein the first current is equal to a sum of the second current, the third current and the fourth current.

6. The bandgap reference voltage generator circuit according to claim 2, wherein the first P-channel MOSFET comprises a first gate having a first width-to-length value, and wherein the second P-channel MOSFET comprises a second gate having a second width-to-length value, and wherein the output voltage generated by the operational amplifier is applied to the first gate of the first P-channel MOSFET and to the second gate of the second P-channel MOSFET to adjust the first current generated by the first P-channel MOSFET and the fifth current generated by the second P-channel MOSFET.

7. The bandgap reference voltage generator circuit according to claim 4, wherein the first PNP bipolar junction transistor has a first PN junction area and a first base-to-emitter voltage, and wherein the second PNP bipolar junction transistor has a second PN junction area that is N times greater than the first PN junction area and a second base-to-emitter voltage that is less than the first base-to-emitter voltage.

8. The bandgap reference voltage generator circuit according to claim 6, wherein the second width-to-length value of the second P-channel MOSFET is identical to the first width-to-length value of the first P-channel MOSFET.

9. A bandgap reference voltage generator circuit, comprising:

an operational amplifier comprising: a first inverting input coupled to a first node and being configured to receive a first voltage generated at the first node and a second non-inverting input coupled to a second node and being configured to receive a second voltage generated at the second node, and an output that is configured to generate an output voltage;

a current mirror configured to be coupled to a supply voltage less than or equal to 1.35 volts, wherein the current mirror comprises: a first P-channel MOSFET configured to generate a third voltage and a first current;

a first branch coupled to the current mirror and configured to receive a second current that is a first portion of the first current, wherein the first branch comprises: a first PNP bipolar junction transistor; and a first resistor coupled to the first PNP bipolar junction transistor at the second node that is coupled to the second non-inverting input, wherein the first resistor has a first resistance value;

a second branch coupled to the first branch and configured to receive a third current that is a second portion of the first current, wherein the second branch comprises: a voltage divider comprising: a second resistor coupled to a third resistor and being configured to divide the third voltage to generate the first voltage at the first node that is coupled to the first inverting input, wherein the first voltage is less than the third voltage, wherein a second resistance value of the second resistor is the same as a third resistance value of the third resistor and the same as the first resistance value of the first resistor;

a third branch coupled to the second branch, the third branch comprising: a fourth resistor being configured to receive a fourth current that is a third portion of the first current, wherein the fourth current generates a fifth voltage that reduces the third voltage, wherein the first current is equal to a sum of the second current, the third current and the fourth current, wherein the fourth current flows through the fourth resistor to generate a fifth voltage that lowers the third voltage low enough to cause the first P-channel MOSFET to operate in saturation mode when the supply voltage is less than or equal to 1.35 volts, wherein a first difference between the supply voltage and the third voltage is greater than a second difference between a gate-to-source voltage of the first P-channel MOSFET and a threshold voltage of the first P-channel MOSFET, which causes the first P-channel MOSFET to operate in saturation mode; and a fourth branch comprising: a fifth resistor being configured to receive a fifth current that is generated by the current mirror and that is used to generate a bandgap reference voltage that is less than or equal to 0.8 volts, wherein the fourth resistor has a fourth resistance value that is selected to be greater than a fifth resistance value of the fifth resistor and cause a temperature coefficient of the bandgap reference voltage to be approximately equal to zero.

10. A bandgap reference voltage generator circuit, comprising:

an operational amplifier comprising: a first inverting input coupled to a first node and being configured to receive a first voltage generated at the first node and a second non-inverting input coupled to a second node and being configured to receive a second voltage generated at the second node, and an output that is configured to generate an output voltage;

a current mirror configured to be coupled to a supply voltage less than or equal to 1.35 volts, wherein the current mirror comprises: a first P-channel MOSFET configured to generate a third voltage and a first current;

a first PNP bipolar junction transistor;

a first resistor coupled to the current mirror and configured to receive a second current that is a first portion of the first current, wherein the first resistor is coupled to the first PNP bipolar junction transistor at the second node that is coupled to the second non-inverting input, wherein the first resistor has a first resistance value;

a voltage divider coupled to the first resistor, the voltage divider comprising: a second resistor coupled to a third resistor, and being configured to receive a third current that is a second portion of the first current and being configured to divide the third voltage to generate the first voltage at the first node that is coupled to the first inverting input, wherein the first voltage is less than the third voltage, wherein a second resistance value of the second resistor is the same as a third resistance value of the third resistor and the same as the first resistance value of the first resistor;

a fourth resistor coupled to the first resistor and having a fourth resistance value, the fourth resistor configured to receive a fourth current that is a third portion of the first current, wherein the fourth current generates a fifth voltage that reduces the third voltage, wherein the fourth current flows through the fourth resistor of the third branch to generate a fifth voltage that lowers the third voltage low enough to cause the first P-channel MOSFET to operate in saturation mode when the supply voltage is less than or equal to 1.35 volts, wherein a first difference between the supply voltage and the third voltage is greater than a second difference between a gate-to-source voltage of the first P-channel MOSFET and a threshold voltage of the first P-channel MOSFET, which causes the first P-channel MOSFET to operate in saturation mode; and a fifth resistor coupled to the current mirror and being configured to generate a bandgap reference voltage based on the first current, that is less than or equal to 0.8 volts, wherein the fourth resistance value is greater than a fifth resistance value of the fifth resistor, and wherein the fifth resistance value of the fifth resistor is selected to cause a temperature coefficient of the bandgap reference voltage to be approximately equal to zero.

* * * * *